US010221520B1

(12) United States Patent
Weiner

(10) Patent No.: US 10,221,520 B1
(45) Date of Patent: Mar. 5, 2019

(54) YARN TWIST DIFFERENTIAL CARPET CONFIGURATION

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 191 days.

(21) Appl. No.: 14/617,054

(22) Filed: Feb. 9, 2015

Related U.S. Application Data

(60) Provisional application No. 61/983,046, filed on Apr. 23, 2014.

(51) Int. Cl.

| | |
|---|---|
| ***D05C 15/04*** | (2006.01) |
| ***D06N 7/00*** | (2006.01) |
| ***D05C 15/26*** | (2006.01) |
| ***D02G 3/44*** | (2006.01) |

(52) U.S. Cl.
CPC ..... *D06N 7/0049* (2013.01); *D02G 3/445* (2013.01); *D05C 15/04* (2013.01); *D05C 15/26* (2013.01)

(58) Field of Classification Search
CPC ..... D05C 15/00; D05C 15/02; D05C 15/026; D05C 15/04; D05C 15/16; D05C 15/26
See application file for complete search history.

(56) References Cited

U.S. PATENT DOCUMENTS 5,224,434 A * 7/1993 Card ..... D05C 15/30 112/475.23
5,413,832 A * 5/1995 Willey ..... D04H 11/00 112/410
5,577,376 A * 11/1996 McAllister ..... D02G 3/286 57/204
5,706,642 A * 1/1998 Haselwander ..... D01H 1/10 57/264
2004/0022985 A1* 2/2004 Higgins ..... A47G 27/0293 428/48
2004/0253408 A1* 12/2004 Hutchison ..... A47G 27/0243 428/89
2005/0048253 A1* 3/2005 Nord ..... B32B 5/08 428/89
2005/0279075 A1* 12/2005 Kersey ..... D01H 1/115 57/314
2006/0037154 A1* 2/2006 Goineau ..... D02G 1/00 8/478
2006/0046020 A1* 3/2006 Kersey ..... D02G 3/288 428/92
2007/0254130 A1* 11/2007 Cheek ..... B32B 5/22 428/95
2007/0275207 A1* 11/2007 Higgins ..... B32B 5/16 428/95
2008/0041286 A1* 2/2008 Tick ..... A47G 27/0275 112/475.23
2012/0064281 A1* 3/2012 Taylor ..... B60R 13/083 428/92

* cited by examiner

*Primary Examiner* — Nathan E Durham
(74) *Attorney, Agent, or Firm* — Stephen J. Stark; Miller & Martin PLLC

(57) ABSTRACT

Differential yarn twist has been found to increase the durability factor of carpet in an unexpected manner while providing a wide range of aesthetic effects. First and second adjacent yarns have different rates of twist. They can be tufted with a single needle or adjacent needles for various embodiments.

5 Claims, 1 Drawing Sheet

YARN TWIST DIFFERENTIAL CARPET CONFIGURATION

CLAIM OF PRIORITY

This application claims the benefit of U.S. Provisional Patent Application No. 61/983,046 filed Apr. 23, 2014 which is incorporated herein by reference in its entirety.

FIELD OF THE INVENTION

The present invention relates to a new carpet construction utilizing carpet twist differential in an effort to achieve differences not currently experienced in the carpet industry.

BACKGROUND OF THE INVENTION

Masland Carpets has been making for a number of years at least two products namely, ColorTech™ and Jazzed™ which are described as being construction of a combination of a high luster yarn in combination with a lower luster yarn. These designs are not believed to have a construction in which those yarns are directed through a single needle. Furthermore, these designs are also believed to utilize the same twist rate among the various yarns as is normally and believed to be exclusively, in carpet constructions.

Accordingly, there is believed to be a need for an improved carpet construction.

Additionally, there is a significant amount of effort that has gone into constructing various yarns. Patents such as U.S. Pat. No. 5,413,857 show a particular construction for a yarn.

The applicant believes that there is a need for utilizing prior art yarns in a new way to achieve new effects some of which have been experienced with the yarn constructions while others, some of which have been experienced by attempting to create new yarn constructions, and still others have yet undiscovered effects.

Accordingly there is believed to be a need for a new carpet construction.

SUMMARY OF THE INVENTION

Accordingly, it is the object of the present invention to provide an improved carpet construction.

It is another object of the present invention to provide an improved method of manufacturing carpet.

It is another object of many embodiments of the present invention to provide an improved carpet construction wherein at least two yarns are directed through a single needle having a twist differential between the two yarns.

It is another object of at least some embodiments of the present invention to provide an improved carpet construction wherein a twist differential (i.e., by way of example, one yarn having a high twist as defined as four or more twists per inch) of at least two filaments in a first yarn and a second yarn having a low twist as defined as less than four twists per inch among at least two filaments.

Furthermore, for at least some embodiments, the higher twist yarn is preferably a high luster yarn construction whereas the lower twist yarn is preferably a more delustered yarn than the high twist yarn for at least some embodiments.

For still other embodiments, a yarn twist differential could exist between two yarns in a carpet design whereby a first yarn has a first twist per inch, and a second yarn has a second twist per inch lower than the first twist per inch. The differential or twist differential gives rise to at least one of functional and aesthetic characteristics.

Accordingly, in accordance with the presently preferred embodiment of the present invention, a twist differential carpet design is manufactured as provided. Specifically, at least first and second yarns may be directed through a single eye of a needle when manufacturing carpet and/or in adjacent needles. These two yarns may be running side by side, if not parallel, may be twisted, may be cabled, may be core cabled, or other methods of providing yarns through a single or multiple needles in such embodiments. The first yarns may, or may not, be a high twist yarn as defined as having at least four twists per inch. The second yarn may, or may not, be a low twist yarn comprised of less than four twists per inch. By combining these two yarns together, an unexpected result of having a higher durability over a linear relationship between the amounts of higher and lower twist yarn can be achieved while providing a more economical carpet product with higher performance than would otherwise be expected. Furthermore, a different aesthetic appearance is provided than if all high twist yarns are used. This is also different when utilizing all lower twist yarn in that a higher durability can be experienced over prior art construction.

First and second yarns are preferably dyed before tufting, such as solution dyed yarns or skein dyed yarns. Furthermore one of the first and second yarns may have no twist at all for at least some embodiments.

Other twist differential carpet designs may have at least one if not two or more twists per inch differential between first and second yarns (i.e., three twists per inch vs. five twists per inch, etc.) whether or not they are high and low twist, both high twist, both low twist or one of each.

Furthermore, when utilizing the high luster yarn for the high twist yarn and a low luster yarn for the low twist yarn, still further aesthetic effects can be achieved than have been previously experienced in prior art constructions.

While utilizing multiple yarns to a single needle as a presently preferred embodiment, it may be possible for other embodiments to utilize a single yarn end through each needle with adjacent needles providing the first yarn and second yarn respectively for at least some embodiments which can still achieve the increased durability of something similar to a high twist (or higher twist) yarn construction while providing a lower weight and thus easier to install product and also a more economical product for the carpet manufacturer with yet a different aesthetic appearance than has been achieved with prior art constructions.

Whereas a 50-50 ratio of high twist and low twist yarns was utilized for a test embodiment, the expected characteristics would be a durability factor also referred to as a wear index or carpet performance rating of half way between that of the high twist yarn and the low twist yarn like the carpet density. This was not the case. In fact, the durability factor has been found to be at least 10% higher than that of the calculated linear amount thereby providing an unexpected result over prior art constructions.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
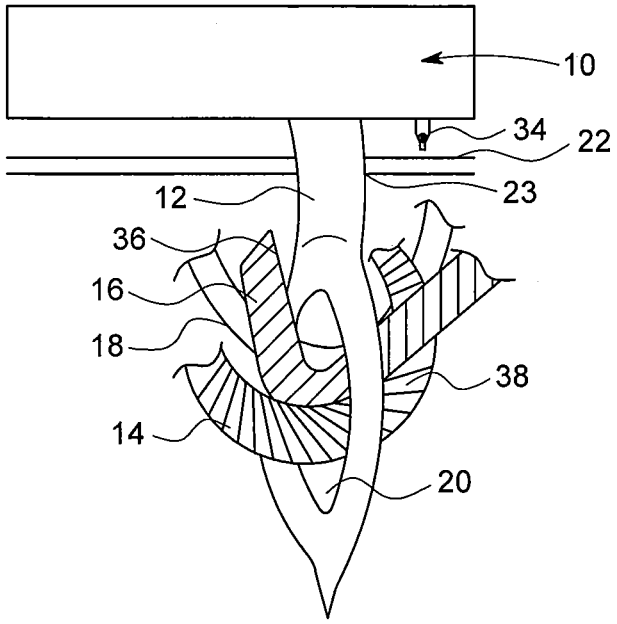
FIG. 1 is a perspective view of a portion of a tufting machine tufting at least first and second yarns through a vacuum.

FIG. 1 shows a presently preferred embodiment of the present invention of a tufting machine 10 with an exemplary first needle 12 which will have at least one if not a plurality of yarns illustrated as first yarn 14, second yarn 16, third yarn 18 directed through an eye 20 of a needle 12 for at least some embodiments. Other embodiments may have only a single yarn such as first yarn 14, second yarn 16, or third yarn 18 directed therethrough as will be explained in further detail below. First yarn 14 is illustrated as having a higher twist per inch than second yarn 16. Second yarn 16 may have no twist, or virtually no twist, for at least some embodiments.

Figure 2:
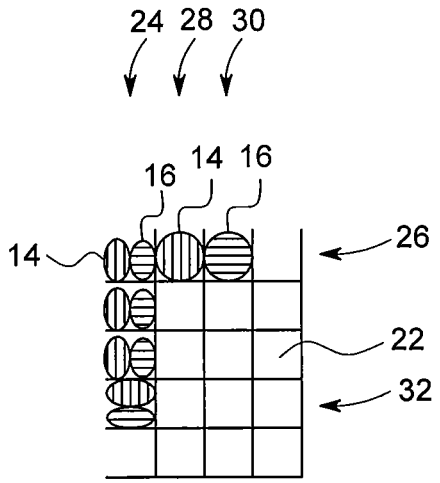
FIG. 2 shows a portion of a carpet design in accordance with a presently preferred embodiment of the present invention.

While tufting with tufting machine 10, first and second yarns 14,16 can be tufted in a single location with a single needle 12 shown in FIG. 2 is also possible that a single yarn 14 first yarn 14 and second yarn 16 can be tufted side by side and is also shown in FIG. 2 through adjacent needles 12,34 as would be understood by those of ordinary skill in the art through backing 22 in order to create a design.

First yarn 14 is shown as a high twist yarn as having four or more twists per inch in one embodiment of component filaments 38. Second yarn 16 is shown as a low twist yarn as one having less than four twists per inch of component filaments 38. Other embodiments may have other twist differentials. Furthermore, for at least some embodiments, first yarn 14 has a higher twist than second yarn 16 (i.e., lower twist) such as at least about one or two twists or more per inch more than the second yarn 16. For some embodiments, this could mean first yarn 14 could have five twists per inch and the second yarn 16 could have three twists per inch, etc. In such embodiments the yarns could both be high twist yarns. Both could be low twist yarns. Furthermore, one could be high twist and one could be low twist yarns. Second yarn 16 could also have no twist for at least some embodiments.

The applicant has discovered that the wear rating or wear index of one of a carpet tufted with a first yarn and a second yarn such as a 50-50 ratio could be achieved either in the first column 24 shown in FIG. 2 such as by those having first and second yarns 14,16 tufted through a single needle 12 or as also shown in first row 26 in second and third columns 28,30 such as would be accomplished by adjacent needles 12,34. The applicant has discovered very interesting properties of the carpet 32 tufted by such a process. Specifically, while a density of the carpet 32 changes linearly by the weight of the first yarn 14 compared to the second yarn 16 in ordinary relationship, the durability does not change along the seams linear relationship. In fact, on a 50-50 blend of the first and second yarns 14,16 whether introduced through a single needle 12 or adjacent needles 12,34 the applicant has discovered that the durability or wear factor is greater than the linear relationship that would otherwise provide.

For instance, if the density of a carpet design 32 using all higher twists 14 were 5.0 and the density of using all low twists 16 were 4.0, the density of the carpet design 32 would be 4.5. However, if the wear rating of the high twist carpet design 32 were 4.0 and the wear rating of the carpet design 32 utilizing just the lower twist yarn 16 is 3.0, one would expect that the durability factor would be 3.5. This is not the case. The applicant has found that the durability factor is at least 3.6 or at least about 20% greater than the corresponding increase in density. For many embodiments, the applicant has even found that the durability factor increases for a 50-50 blend is at least approximately about 10%, if not about 30% or almost 40% higher than expected or more like the high twist yarn than the low twist yarn.

For a 30-70 blend one may expect a weighted average such as $4.0\times(0.3)+3.0(0.7)=3.3$. However, once again, at least approximately about a ten percent, if not about twenty, thirty, or forty percent above the weighted average for the wear rating can be experienced with the preferred embodiment. Other embodiments also experience these unexpected above weighted average wear ratings.

Not only does this allow for the use of less material for a higher quality product than would be anticipated, the applicant has also further discovered that an attractive aesthetic appeal can be provided which has not previously been provided in the marketplace because the twist differential also gives rise to an aesthetic look which is not known to have ever been provided in the marketplace even by adjacent needles 12,34 or by directing multiple yarns 14,16 and or 18 and/or others through a single eye 20 of a needle 12.

When utilizing multiple yarns 14-18 through a single needle 12, one may do this in multiple fashions whether it be parallel feeding, twisting, cabling, core-cabling such as shown in co-pending application Ser. No. 14/160,123, incorporated herein by reference, or other technologies whereby multiple yarns would be simultaneously fed through a single eye 20 of a needle 12. All these type configurations of the present construction are believed to provide an aesthetic look which differs from prior art configurations. Specifically, the present embodiments preferably use pre-dyed yarns such as solution or skein dyed yarns as first and second yarns 16,18.

It may be possible that one of the first, second and third yarns 14,16,18 has a higher twist than the other two or that two or more yarns such as 14,18 have a higher twist than second yarn 16, etc.

The applicant has found that a twist differential of at least about one or two twists per inch, if not more, gives rise to a perceivable aesthetic and/or functional difference.

Additionally, the applicant has discovered that a high twist product such as of about four or more twists per inch can be relatively easily distinguished from a lower twist such as one having three twists per inch or less. In such a case, the twist differential may be as low as one for at least some embodiments but still give rise to a difference than not only aesthetics but also into the performance of the tufted carpet as shown on the figures.

It should also be noted that the first and second yarns 14,16 could be selected as having the same or similar density with a different twist rate and thereby still provide a twist differential. The wear rating of such embodiments has also been found to not merely be the same linear relationship between the twist differences of a carpet 32 formed completely of the first yarn 14 or the second yarn 16 in the linear relationship. Instead, the resulting carpet 32 has been designed to have a greater performance or wear rating than the anticipated results by at least 10%, if not about 20% or more.

Accordingly, applicant believes that twist differential is desirable in many embodiments.

Furthermore, for at least some embodiments, the higher or high twist as defined by four or more twists per inch or even a higher twist yarn such as first yarn 14 may be a high luster yarn and the lower twist yarn 16 may be a low or lower luster yarn (or vice versa) to still give even further aesthetic appearance to at least some embodiments. Still other design and/or functional aspects can be incorporated in this technology as would be understood by those of ordinary skill in the art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of tufting carpet having a yarn twist differential comprising the steps of:

a) tufting a first dyed yarn of a uniform first twist rate of component filaments to a tufting machine through a carpet backing;

b) simultaneously tufting a separate second dyed yarn of a uniform second twist rate of component filaments fed to the tufting machine through the carpet backing adjacent to the first yarn through by a single needle directing the first and second yarns together simultaneously through the backing; thus producing a carpet, wherein the first twist rate and the second twist rate are different.

2. The method of tufting carpet of claim 1 wherein the first twist rate is at least four, and the second twist rate is less than four.

3. The method of tufting carpet of claim 1 wherein the first twist rate is at least one twist per inch greater than the second twist rate.

4. The method of tufting carpet of claim 1 wherein the first and second yarns are one of twisted, cabled, and core cabled.

5. The method of tufting carpet of claim 1 wherein the second yarn is a more delustered yarn than the first yarn.

* * * * *